United States Patent [19]

Sasaki et al.

[11] Patent Number: 4,953,513

[45] Date of Patent: Sep. 4, 1990

[54] ENGINE CONTROL APPARATUS

[75] Inventors: Masahiro Sasaki; Osamu Abe; Hideaki Ishikawa, all of Katsuta, Japan

[73] Assignees: Hitachi, Ltd., Tokyo; Hitachi Automotive Engineering, Inc., Ibaraki, both of Japan

[21] Appl. No.: 321,383

[22] Filed: Mar. 10, 1989

[30] Foreign Application Priority Data

Mar. 12, 1988 [JP] Japan ..... 63-57355

[51] Int. Cl.[5] ..... F02M 51/00

[52] U.S. Cl. ..... 123/489; 123/492

[58] Field of Search ..... 123/489, 488, 491, 490, 123/492; 364/431.07

[56] References Cited

U.S. PATENT DOCUMENTS

| | | | |
|---|---|---|---|
| 4,711,200 | 12/1987 | Kinoshita | 123/492 |
| 4,744,345 | 5/1988 | Yamato | 123/489 |
| 4,744,346 | 5/1988 | Morita et al. | 123/492 |
| 4,751,009 | 6/1988 | Otobe | 123/492 |
| 4,753,208 | 6/1988 | Yamato et al. | 123/492 |
| 4,754,736 | 7/1988 | Yamato et al. | 123/492 |
| 4,787,358 | 11/1988 | Kasanami et al. | 123/492 |
| 4,800,860 | 1/1989 | Nanyoshi et al. | 123/492 |
| 4,831,987 | 5/1989 | Nakaniwa et al. | 123/488 |
| 4,842,711 | 6/1989 | Asakura et al. | 123/489 |

FOREIGN PATENT DOCUMENTS

| | | | |
|---|---|---|---|
| 0159637 | 7/1988 | Japan | 123/489 |
| 0129845 | 9/1988 | Japan | 123/489 |
| 0219840 | 9/1988 | Japan | 123/489 |
| 0248947 | 10/1988 | Japan | 123/489 |

*Primary Examiner*—Raymond A. Nelli

*Attorney, Agent, or Firm*—Antonelli, Terry, Stout & Kraus

[57] ABSTRACT

An engine control apparatus in which a basic fuel injection pulse width is calculated based on various data from various sensors provided for an engine, the basic fuel injection pulse width is corrected by various factors determined based on engine conditions, and a fuel injector provided for the engine is controlled based on the corrected fuel injection pulse width, is characterized in that a period of time from a time the engine is controlled to accelerate whereby an air-fuel ratio changes into a lean state until a time the air-fuel ratio changes into a rich state is detected, and a fuel increment for the acceleration is corrected, based on the detected period of time.

19 Claims, 4 Drawing Sheets

| | | | | | | | | |
|---|---|---|---|---|---|---|---|---|
| $Kac_1$ | $Kac_2$ | $Kac_3$ | $Kac_4$ | $Kac_5$ | $Kac_6$ | $Kac_7$ | $Kac_8$ | $Kac_n$ (n=1~8) |
| $t_1$ | $t_2$ | $t_3$ | $t_4$ | $t_5$ | $t_6$ | $t_7$ | $t_8$ | |

ENGINE CONTROL APPARATUS

BACKGROUND OF THE INVENTION

The present invention relates to a control apparatus for an internal combustion engine such as a gasoline engine provided with feedback control of the air-fuel ratio and, more particularly, to an engine control apparatus which provides a correction of the fuel increment for acceleration and is suitable for an internal combustion engine of an automobile.

In general, automobiles are frequently subjected to acceleration and deceleration control during their operation. Therefore, as disclosed, for example, in Japanese Patent Laid—Open No. 58-144632, fuel injection control of an internal combustion engine for automobiles provides for correction of a fuel increment for acceleration, i.e. has an acceleration correction incorporated therein, so that the automobile will have a desired acceleration performance.

The Japanese Patent Laid-Open discloses an improvement in an electronic control fuel injection method wherein a basic fuel injection amount is obtained based on suction pipe pressure and the r.p.m. of the engine and, at a transition point, the fuel injection amount is determined by correcting the basic fuel injection amount according to the engine conditions. According to the improvement, a value is obtained by integrating an estimate preset according to the variation $\Delta PM$ of the suction pipe pressure at each prescribed time and this value is used as a correction coefficient, and correction of fuel increment for acceleration is carried out using the correction coefficient according to an increase rate of the suction pipe pressure.

The above-mentioned conventional method, however, does not pay attention to whether or not the fuel increment amount added according to the prescribed condition, such as the suction pipe pressure variation, is proper. Therefore, there is no guarantee that an optimum acceleration performance is maintained at all times.

SUMMARY OF THE INVENTION

An object of the present invention is to provide an engine control apparatus for maintaining an excellent acceleration performance at all times by applying a prescribed correction for acceleration at all times regardless of a deterioration with the passage of time of engine characteristics.

Briefly stated, the present invention is characterized by judging whether a fuel increment correction for acceleration is effected properly, based on a period of time necessary for an air-fuel ratio sensed by an $O_2$ sensor to change from a lean state to a rich state after an engine is accelerated, and correcting the fuel increment for acceleration based on the period of time so as to attain a suitable acceleration performance.

A signal of an air-fuel ratio sensed by an $O_2$ sensor, that is, the output voltage of the sensor, changes to a lean state when the engine is accelerated, and then changes to a rich state because the response delay in a fuel supply line is larger than the one in the suction air line. Then, supposing that T represents a period of time necessary for the signal to change to a rich state after an acceleration control is effected, the period of time T is positively correlated with a acceleration responsiveness. Therefore, detection of the period of time T and correction of the above-mentioned fuel increment correction for acceleration so that the detected period of time T will become proper can maintain a suitably corrected state of the fuel increment correction for acceleration at all times.

DESCRIPTION OF THE INVENTION

Figure 1:
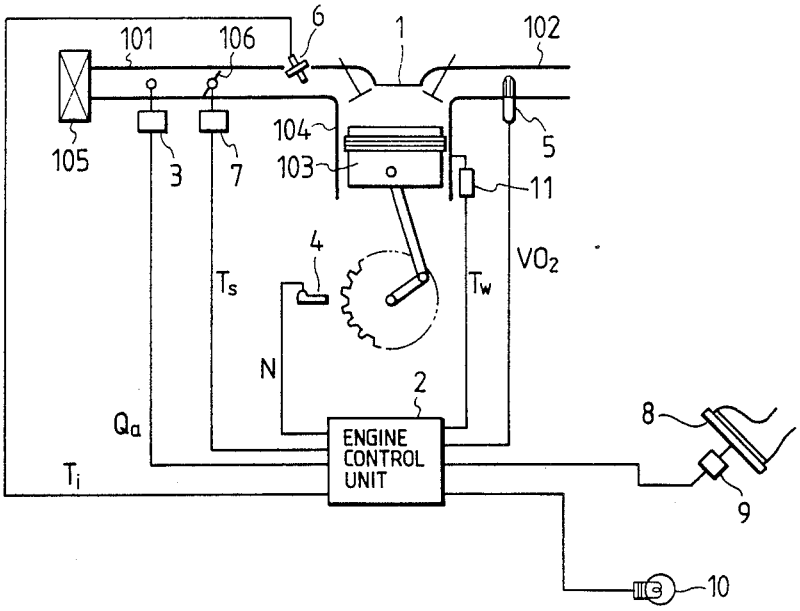
FIG. 1 is a block diagram of an embodiment of an engine control apparatus according to the present invention.

An engine control apparatus according to the present invention will be described below in detail with reference to an embodiment shown in the drawings.

FIG. 1 shows an example of the engine control apparatus to which an embodiment of the present invention is applied.

An engine 1 is provided with a suction pipe 101 and an exhaust pipe 102. The engine 1 causes a piston 103 to reciprocate in a cylinder 104 by combustion of fuel supplied into the cylinder. The reciprocation of the piston 103 causes a crank to rotate and the revolution speed of the crank is detected by a crank angle sensor 4.

The suction pipe 101 is provided with an air flow sensor 3 at a downstream side of an air cleaner 105, a throttle valve 106 with a throttle sensor 7 to detect opening and closing degrees of the throttle valve, and a fuel injector 6 for supplying fuel into the engine. The exhaust pipe 102 is provided with an $O_2$ sensor 5 to detect $O_2$ in the exhaust gas.

The engine 1 further is provided with an engine temperature sensor 11 for outputing a signal corresponding to the engine temperature Tw and an accelerator pedal 8. The accelerator pedal 8 is connected to the throttle valve 106 to operate it and to an idle switch 9 to operate the same, too.

The engine is controlled by a control unit 2. The control unit is electrically connected to various sensors, including the air flow sensor 3, the crank angle sensor 4, the throttle sensor 7, the $O_2$ sensor 5, the idle switch 9, etc., receives various electric signals, including signals indicating the r.p.m. of the engine (N), an amount of $O_2$ ($VO_2$), etc, and a signal from the idle switch 9, and calculates and generates a signal (Ti) to control the fuel injector. A numeral 10 indicates an operation indicating lamp.

The air flow sensor 3 measures a flow rate Qa of air sucked into the engine 1 and inputs it to the control unit 2.

The crank angle sensor 4 generates pulse signals in synchronism with the rotation, of the engine 1 and the control unit 2 calculates the speed N of the engine 1 based on the pulse signals.

Then, the control unit 2 calculates a basic pulse width Tp of pulse signals to be supplied to the injector 6 based on signals from these sensors and supplies the pulse signals to the injector 6 to provide a prescribed air-fuel ratio.

The control unit 2 calculates the basic pulse width Tp based on the following equation:

$$Tp = K \cdot Qa/N \quad (1)$$

wherein K is a constant.

On the other hand, the $O_2$ sensor mounted on the exhaust pipe of the engine 1 generates signals relating to a concentration of $O_2$ (oxygen) in the exhaust gas from the engine 1. The control unit 2 effects feedback control of an amount of fuel to be supplied based on signals from the $O_2$ sensor 5 to attain a desired air-fuel ratio and further in order to make other necessary corrections, the control unit 2 calculates a fuel injection pulse width Ti to be actually supplied to the injector 6 based on the basic pulse width Tp from the following equation:

$$Ti = Tp \cdot \alpha \cdot (1 + Kac + K1) \quad (2)$$

wherein $\alpha$ is a feedback correction coefficient

Kac is an acceleration correction coefficient

K1 is another correction coefficient.

Figure 2:
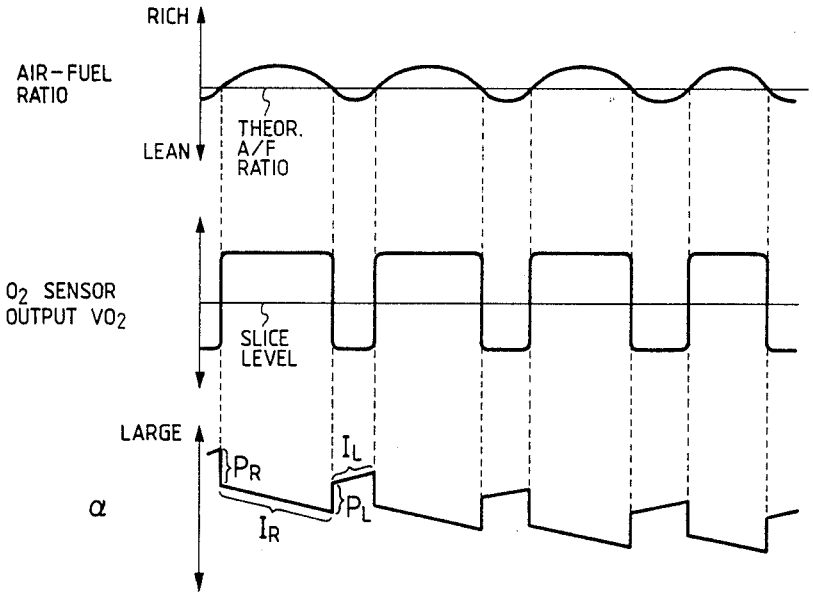
FIG. 2 is a diagram showing the air-fuel ratio and oxygen sensor output in relation to an air fuel-ratio feedback coefficient $\alpha$.

The feedback control is effected to inject fuel of a precise amount so that an air-fuel ratio will be within a narrow range (called window) the center of which is a desired air-fuel ratio such as a theoretical air fuel ratio. The feedback correction coefficient $\alpha$ in the equation (2) is calculated by the control unit 2 based on an output voltage $VO_2$ from the $O_2$ sensor 5, as shown in FIG. 2. The coefficient $\alpha$ is designed in such a way that, when the air-fuel ratio changes from a leaner state than a theoretical air-fuel ratio to a richer state, the output signal of the $O_2$ sensor rises stepwise and the coefficient $\alpha$ is lowered by a value corresponding to a proportional portion Pr and then is gradually decreased according to an integration portion Ir, while when it changes from a rich state to a lean state, the output voltage of the $O_2$ sensor drops stepwise and the coefficient $\alpha$ is increased by a proportional portion $P_1$ and then is gradually increased according to an integration portion $I_1$. The control unit 2 calculates the feedback correction coefficient $\alpha$. Therefore, the air-fuel ratio is always subjected to a negative feedback control.

The acceleration correction coefficient Kac is used to effect fuel increment correction when it is sensed by various kinds of sensors, such as a throttle sensor 7, that the accelerator pedal 8 is depressed to accelerate the engine 1. Further, the other correction coefficient K1 is provided for effecting various kinds of corrections necessary for controlling the engine.

Incidentally, as described above, although the prior art makes use of the acceleration correction coefficient Kac, no consideration is given as to whether or not the amount of fuel injected according to the acceleration correction coefficient Kac is proper so that it is not certain whether control will always provide a proper correction suited to an accelerating state and to provide a satisfactory responsiveness to acceleration.

As shown in the following equation (3), $$Ti = Tp \cdot \alpha \cdot (1 + Kacn + K1) \quad (3)$$

wherein $Kacn = Kac + K0$

K0 is a correction coefficient, the present embodiment employs the acceleration correction coefficient Kacn so that a sufficient responsiveness to acceleration can be obtained, which will be described below in detail, referring to FIG. 3 in addition to FIG. 1.

Supposing that the accelerator pedal 8 is depressed at a time $t_0$ to accelerate the engine 1, the behavior of an output $VO_2$ from the $O_2$ sensor 5 at that time will be studied. As shown in FIG. 3, the output $VO_2$ will decrease at the time $t_0$, which represents that the air-fuel ratio has become lean at the time $t_0$ and then it increases stepwise after a prescribed period of time T, which means that the air-fuel ratio changes to a rich state. This is because the suction system of the engine 1 responds to air sooner than it responds to fuel so that when the throttle valve 106 is opened, the intake of air is increased first and then the fuel increase follows. As a result, a period of time T until the air-fuel ratio changes to the rich state after it becomes lean depends on a fuel increment amount. When the amount of fuel is greater than necessary, a characteristic 31 shown in the drawing is obtained wherein the air-fuel ratio represented by the output $VO_2$ becomes rich quickly and the period of time required is $T_1$ as shown in the drawing, while when the amount of fuel is less than necessary, a characteristic 32 shown in the drawing is obtained wherein the time period T has a large delay as shown by $T_2$. In conclusion, when a suitable amount of fuel is increased, a characteristic 30 is obtained wherein the period of time is $T_0$.

In this embodiment a period of time T, which elapses until an output $VO_2$ of the $O_2$ sensor exceeds a prescribed slice level $V_1$ after the engine 1 is controlled to accelerate the vehicle and the air-fuel ratio becomes lean, is measured, and the acceleration correction coefficient Kacn is corrected so that the period of time T will converge on a time period $T_0$ which is determined in advance through experiments so as to impart an optimum acceleration to the engine 1, whereby an optimum acceleration correction is ensured at all times.

Figure 3:
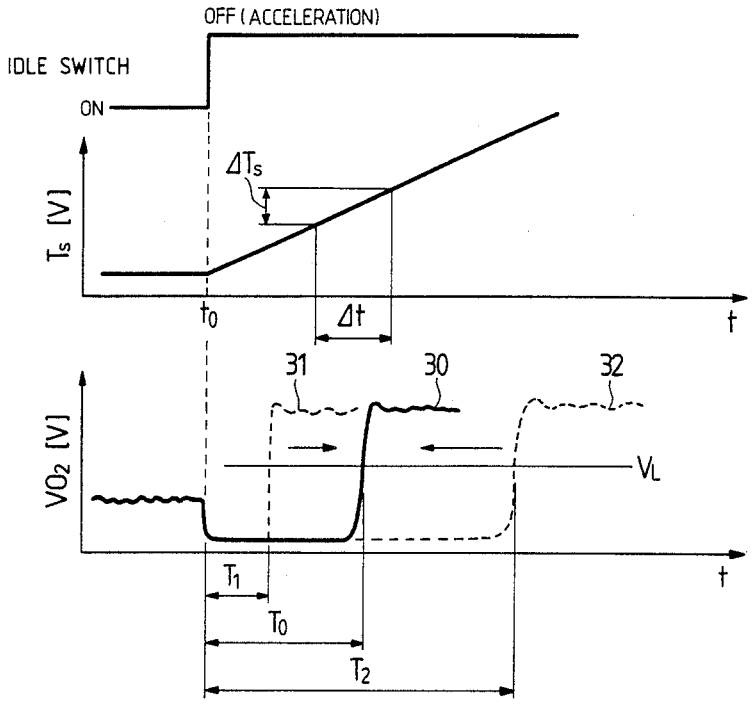
FIG. 3 is a diagram showing a relationship between a correction for acceleration and an air-fuel ratio and showing changes in a throttle sensor output and an $O_2$ sensor output.
Figure 4:
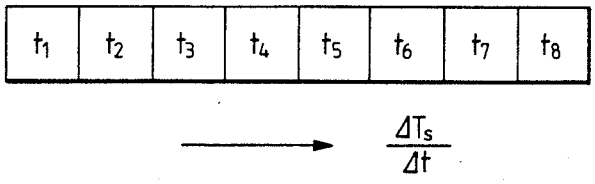
FIG. 4 is a diagram explanatory of a table for reference periods of time.

In the embodiment, an acceleration is sensed based on a rate of change $\Delta Ts/\Delta t$ of an output Ts from the throttle sensor 7, as shown in FIG. 3, and further an amount of fuel increment correction for acceleration is controlled based on the rate of change $\Delta Ts/\Delta t$, i.e., a degree of speed of acceleration effected by the accelerator pedal 8, thereby providing better acceleration characteristics. Therefore, periods of time which are deemed optimum are selected in advance as reference periods of time $t_1$–$t_8$ in accordance with the rates of change $\Delta Ts/\Delta t$ at respective times and they are tabulated as shown in FIG. 4. The table is searched based on the rate of change $\Delta Ts/\Delta t$ to get a reference value corresponding to the rate of change.

Next, the aforesaid operation effected by the control unit 2 of the embodiment will be described with reference to a flow chart in FIG. 5.

First, the control unit 2 receives data concerning an amount of suction air flow rate Qa, an speed signal N of the engine, an output voltage $VO_2$ of the $O_2$ sensor, an output Ts of the throttle sensor and an engine temperature Tw and calculates a basic pulse width Tp, the feedback control coefficient $\alpha$, the acceleration correction coefficient Kac and the other correction coefficient K1 based on those signals (step 70). This step 70 is conventional.

Next, the control unit 2 compares a rate of change $\Delta Ts/\Delta t$ with a prescribed reference value A set in advance and when a result of the comparison is YES, that is, when the rate of change is equal to the reference value A or above, it is determined that an acceleration condition exists and when it is NO, that is, the change rate is less than the reference value A, it is determined that the engine is not to be accelerated (step 71). At this time, the reference value A is a reference period of time corresponding to a minimum rate of change in throttle sensor output at which acceleration correction is necessary, that is, the reference value A is set as follows:

$A=t_1$.

Next, the control unit 2 determines a reference period of time $t_n$ (n=1-8) corresponding to the rate of change $\Delta Ts/\Delta t$ by searching the table in FIG. 4 based on the rate of change (step 72). Each reference period of time tn (n1-8) is given corresponding to each of eight acceleration ranges of $\Delta Ts/\Delta t$ into which a rate of change $\Delta Ts/\Delta t$ from a minimum rate of change at which acceleration correction is necessary to a maximum rate of change at which an acceleration speed is maximum is divided.

Next, the control unit 2 measures the period of time T as described in FIG. 3 (step 73).

Next, the control unit 2 determines whether the period of time T is within the following prescribed range which is determined by the period of time $t_n$ (any one of $t_1$ to $t_8$) determined according to the rate of change $\Delta Ts/\Delta T$, and the prescribed value $\beta$ (step 74):

$$t_n(1-\beta) \leqq T \leqq t_n(1+\beta)$$

wherein $\beta$ is set in advance to be a value so as to satisfy the following:

$$t_{n+1}(1-\beta) > T_n(H\beta)$$

$$0<\beta<1,\ t_{n+1}>t_n.$$

Figures 6, 7:
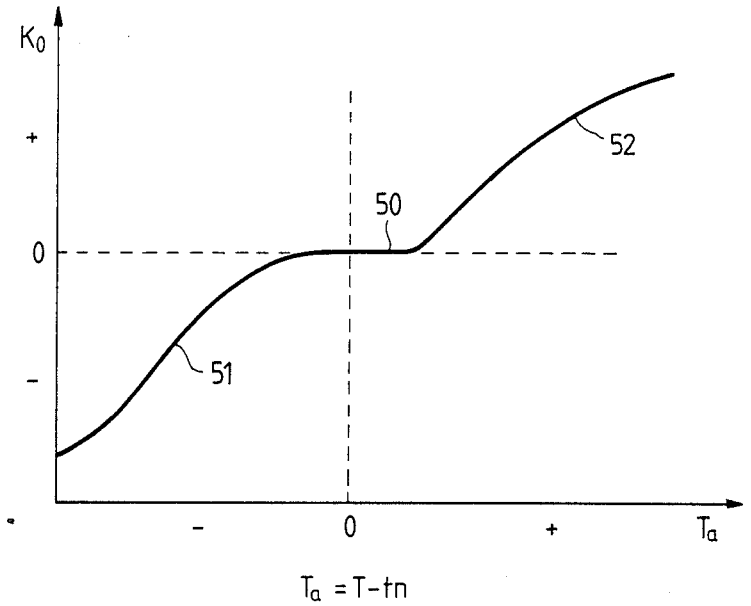
FIG. 6 is a diagram explanatory of a characteristic function between a coefficient Ko and a variable Ta.
FIG. 7 is a diagram explanatory of a map for acceleration correction coefficients.

When a result of the step 74 is NO, the control unit 2 determines a variable Ta by the following calculation and then calculates a coefficient Ko based on the variable Ta by use of a characteristic function shown in FIG. 6 which is obtained in advance through experiment (step 75).

$$Ta=T-t_n \rightarrow Ko$$

After that, the control unit 2 calculates a new correction coefficient Kacn based on the coefficient Ko (step 76).

Finally, the control unit 2 calculates a fuel injection pulse width Ti based on the equation (3) to terminate the steps (step 77).

When a result of the step 71 is NO, the acceleration correction coefficient Kacn in the equation (3) is made zero and the fuel injection pulse is calculated according to the equation (3) with Kacn of 0 because the engine is not controlled to accelerate and there is no need to effect fuel increment correction for acceleration. When a result of the step 74 is YES, the control unit 2 executes the step 77 without renewal of Kacn to terminate the processing.

As shown in FIG. 7, the acceleration correction coefficients Kacn necessary for calculating the fuel injection pulse width Ti in the step 77 are arranged in a map in advance corresponding to the reference period of time $t_n$ and stored in the control unit 2, and the acceleration correction coefficients Kacn are searched for use based on the reference period of time $t_n$. On the other hand, the map in FIG. 7 is such that every time new acceleration correction coefficients Kacn are calculated through the execution of the steps 75, 76, their corresponding coefficients are rewritten for updating, that is, they progress in learning.

Therefore, according to the embodiment, an optimum correction for acceleration is given according to a magnitude of the rate of change $\Delta Ts/\Delta t$ of the output Ts of the throttle sensor 7, i.e. a degree of speed at which acceleration is actually effected and further it is corrected through learning, so that a stable acceleration performance can be maintained for ever.

Figure 5:
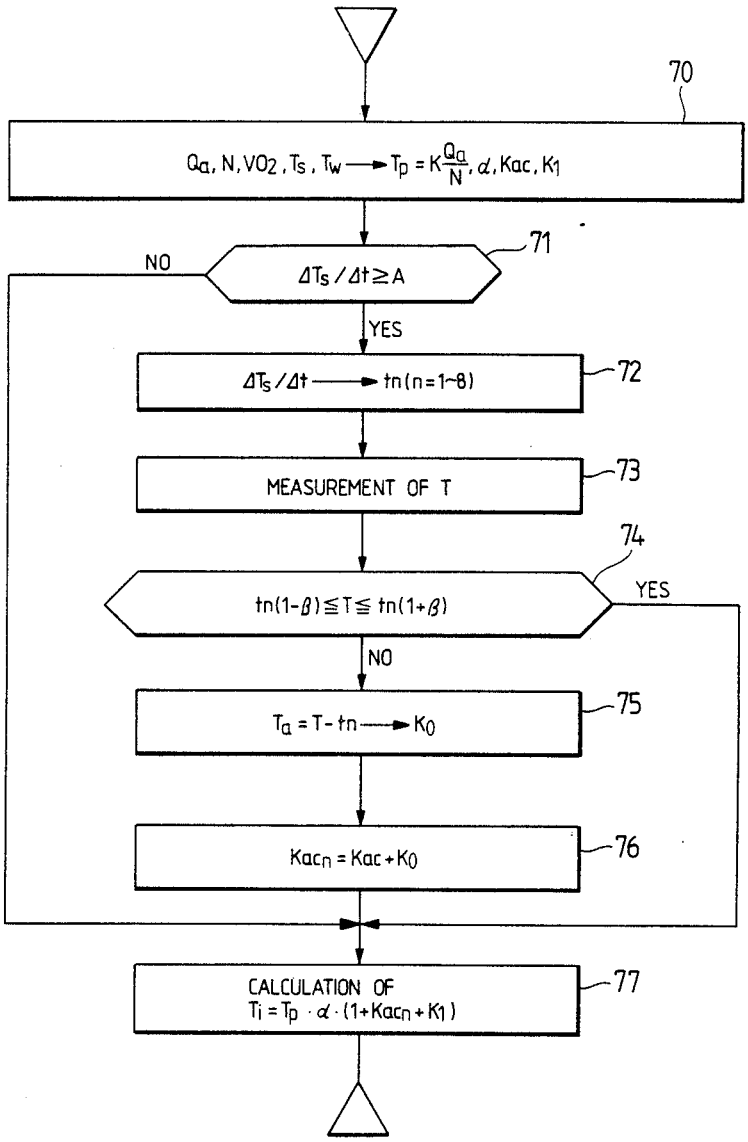
FIG. 5 is a flow chart explanatory of operation of an embodiment of the present invention.

As shown in the step 71 in FIG. 5, although the embodiment senses whether acceleration is effected based on a magnitude of the rate of change $\Delta Ts/\Delta t$ of the output Ts, the acceleration operation may be sensed by turning on and off the idle switch 9 in place of the method as shown in FIG. 3.

According to the present invention, a responsiveness to acceleration can be sufficiently improved because fuel increment for acceleration is corrected to be optimum at all times for each of various kinds of acceleration modes such as abrupt acceleration operation, gentle acceleration operation or the like.

What is claimed is:

1. In an engine control apparatus in which a basic fuel injection pulse width is calculated based on data outputs from various sensors provided for an engine, said basic fuel injection pulse width is corrected by various factors determined on the basis of detected engine conditions including the addition of a fuel increment for acceleration, and a fuel injector provided for the engine is controlled on the basis of the corrected fuel injection pulse width, the improvement comprising means for detecting an acceleration degree of the engine, means for detecting the length of a period of time from a time the time is controlled to accelerate, at which time the air-fuel ratio changes into a lean state, until a time the air-fuel ratio changes into a rich state, means for selecting a reference value of a period of time optimum to the detected acceleration degree from a plurality of reference values of a period of time each of which is determined in advance as a time period for change of the air-fuel ratio from a lean state to a rich state according to a respective acceleration degree, and means for correcting said fuel increment for acceleration so that the detected length of the period of time will converge on a selected reference value representing an optimum period of time capable of imparting an optimum acceleration to the engine for a detected deceleration degree.

2. The engine control apparatus according to claim 1, wherein said means includes means for correcting an acceleration correction efficient, according to which the fuel increment for acceleration is effected, based on said detected length of the period of time.

3. In an engine control apparatus including means for calculating a basic fuel injection pulse width based on data outputs from various sensors, means for correcting the basic fuel injection pulse width using a plurality of coefficients including an acceleration correction coefficient, means for generating a control signal for controlling a fuel injector to inject an optimum fuel amount relative to a flow rate of air sucked into the engine based on the corrected fuel injection pulse width, and means for effecting feedback control of an air-fuel ratio to reach a desired value thereof, the improvement comprising means for detecting a rate of change of an output of a throttle sensor, means for detecting the length of a period of time until the air-fuel ratio turns into a rich state after the engine is controlled to accelerate whereby the air-fuel ratio become lean, means for comparing the detected length of the period of time with a prescribed reference length for a period of time which is determined in advance according to said detected rate of change so that an optimum acceleration is carried out, and means for correcting the acceleration correction coefficient so that the detected length of the period of time will converge on the prescribed reference length for a period of time, whereby an optimum acceleration is carried out.

4. The engine control apparatus according to claim 3, wherein the length of said period of time is detected through detection of change in output voltage of an $O_2$ sensor mounted on an exhaust pipe of the engine.

5. The engine control apparatus according to claim 4, wherein said control apparatus further includes means for storing the acceleration correction coefficient, and means for periodically updating the stored acceleration correction coefficient.

6. The engine control apparatus according to claim 3, further including means for storing various reference values of lengths of periods of time according to various ranges of acceleration speed, means for detecting acceleration speed and means for reading out and applying to said correcting means a stored acceleration correction coefficient for the range of acceleration speed in which a detected acceleration speed is included.

7. A control apparatus of an internal combustion engine provided with a suction passage communicating with an air cleaner and said engine to suck air into said engine through said air cleaner, an fuel injector mounted in said suction passage to inject fuel into said engine through said suction passage, an exhaust passage for discharging an exhaust gas, said control apparatus comprising:

means for calculating a basic fuel injection pulse width base on data output from various sensors;

means for correcting said basic fuel injection pulse width using a plurality of coefficients including an acceleration coefficient;

means for generating a control signal for controlling said fuel injector so as to inject an optimum fuel amount relative to a flow rate of air sucked into said engine according to the corrected fuel injection pulse width, said correcting means including means for effecting correction of a feedback control coefficient based on changes in output from an $O_2$ sensor provided in said exhaust passage, whereby a feedback control of an air-fuel ratio is effected to reach a desired value;

means for detecting the length of a period of time from a time when an output of said $O_2$ sensor changes so as to represent a lean state of the air-fuel ratio when said engine is controlled to accelerate until a time when the output of said $O_2$ sensor represents a rich state of the air-fuel ratio;

means for comparing said detected length of the period of time with one of a plurality of prescribed reference values of length of period of time which are determined in advance according to acceleration speed so that an optimum acceleration is carried out; and means for correcting said acceleration correction coefficient so as to cause said detected length to reach said prescribed reference length according to the acceleration speed, thereby to carry out an optimum acceleration through injection of fuel according to the corrected fuel injection pulse width.

8. The control apparatus according to claim 7, wherein the rich state is detected by detection of whether or not the output from said $O_2$ sensor exceeds a prescribed slice level.

9. A method of controlling fuel injection during acceleration of an internal combustion engine, comprising the steps of:

(a) calculating a basic fuel injection pulse width based on data outputs from various sensors;

(b) correcting said basic fuel injection pulse width using a plurality of coefficients including an acceleration correction coefficient;

(c) controlling a fuel injector to inject an optimum fuel amount based on the corrected fuel injection pulse width;

(d) detecting a first time point at which the engine is controlled to accelerate causing the air-fuel ratio to become lean;

(e) detecting a second time point at which the air-fuel ratio first becomes rich after said first time point;

(f) determining the length of time between said first time point and said second time point;

(g) comparing the length of time determined in step (f) to a predetermined value representing an optimum period of time for acceleration to detect the amount of any difference therebetween;

(h) correcting the acceleration correction coefficient of step (b) using an amount detected in step (g); and (i) repeating steps (b) through (h) so that the length of time determined in step (f) will converge on said predetermined value for a period of time.

10. A method of controlling fuel injection according to claim 9, wherein a plurality of different predetermined values are stored corresponding to respective ranges of acceleration speed and step (g) comprises:

(g1) determining a range of acceleration speed by detecting the acceleration speed at which the engine is commanded to accelerate;

(g2) retrieving a predetermined value corresponding to the determined range of acceleration speed; and (g3) comparing the retrieved predetermined value with the length of time determined in step (f).

11. A method of controlling fuel injection according to claim 10, wherein said acceleration speed is detected by detecting the rate of actuation of the throttle valve for effecting acceleration of the engine.

12. A method of controlling fuel injection according to claim 9, wherein a plurality of different values of acceleration correction coefficient are stored corresponding to respective ranges of acceleration speed, and step (b) comprises:

(b1) determining a range of acceleration speed by detecting the acceleration speed at which the engine is commanded to accelerate;

(b2) retrieving an acceleration correction coefficient corresponding to the determined range of acceleration speed; and (b3) correcting said basic fuel injection pulse width using said retrieved acceleration correction coefficient.

13. A method of controlling fuel injection according to claim 12, wherein step (h) includes:

(h1) storing the corrected acceleration correction coefficient according to the acceleration speed detected in step (b1).

14. A method of controlling fuel injection according to claim 12, wherein said acceleration speed is detected by detecting the rate of actuation of the throttle valve for effecting acceleration of the engine.

15. A method of controlling fuel injection according to claim 9, wherein said step (e) comprises:

(e1) detecting whether or not the output of an $O_2$ sensor exceeds a prescribed slice level.

16. An engine control apparatus provided with means for calculating a basic fuel injection pulse width based on data from various sensors including an $O_2$ sensor, means for correcting the basic fuel injection pulse width by a plurality of coefficients including an acceleration correction coefficient, means for generating a control signal for controlling a fuel injector to inject an optimum fuel amount relative to a flow rate of air sucked into the engine based on the corrected fuel injection pulse width, and means for effecting feedback control of an air-fuel ratio to reach a desired value thereof, said control apparatus further comprising:

means for detecting acceleration of the engine to obtain an acceleration speed ($\Delta Ts/\Delta t$);

means for detecting a period of time from a time an output of said $O_2$ sensor changes so as to represent a lean state of the air-fuel ratio when said engine is controlled to accelerate until a time the output of said $O_2$ sensor represents a rich state of the air-fuel ratio;

means for determining a plurality of reference values of period of time each determined according to a respective acceleration speed range so that an optimum acceleration is carried out for that acceleration speed;

means for selecting one of said reference values of period of time corresponding to a detected acceleration speed; and means for obtaining an acceleration correction coefficient (Kacn) corresponding to the selected reference value of a period of time, and for correcting fuel injection pulse width on the basis of said acceleration correction coefficient and said detected period of time to carry out an optimum acceleration.

17. The control apparatus according to claim 16, wherein said means for obtaining an acceleration correction coefficient (Kacn) includes means for comparing the detected period of time with the selected reference value of period of time and for correcting the acceleration correction coefficient according to a value which is determined in advance when the detected period of time is beyond of aa certain limit of the selected reference value of period of time, thereby to effect an adjustment of the acceleration correction coefficient.

18. An engine control apparatus provided with means for calculating a basic fuel injection pulse width based on data from various sensors including an $O_2$ sensor, means for correcting the basic fuel injection pulse width by a plurality of coefficients including an acceleration correction coefficient, means for generating a control signal for controlling a fuel injector to inject an optimum fuel amount relative to a flow rate of air sucked into the engine based on the corrected fuel injection pulse width, and means for effecting feedback control of an air-fuel ratio to reach a desired value thereof, said control apparatus further comprising:

means for detecting acceleration of the engine to obtain an acceleration speed ($\Delta Ts/\Delta t$);

means for detecting a period of time from a time an output of said $O_2$ sensor changes so as to represent a lean state of the air-fuel ratio when said engine is controlled to accelerate until a time the output of said $O_2$ sensor represents a rich state of the air-fuel ratio;

means for determining plurality of reference values of period of time each determined according to a respective acceleration speed range so that an optimum acceleration is carried out;

means for selecting one of a plurality of different acceleration correction coefficients determined in advance according to a detected acceleration speed, and for correcting fuel injection pulse width on the basis of the selected acceleration correction coefficient and said detected period of time to carry out an optimum acceleration.

19. The control apparatus according to claim 18, wherein said acceleration correction coefficient is corrected so that the detected period of time reaches one of the reference values of period of time corresponding to a detected acceleration speed.

* * * * *